United States Patent [19]

Darlington

[11] Patent Number: 4,926,833

[45] Date of Patent: May 22, 1990

[54] COMPOUND BOW WITH ADJUSTABLE CABLE ANCHOR

[76] Inventor: Rex F. Darlington, 3540 Darton Rd., Hale, Mich. 48739

[21] Appl. No.: 310,343

[22] Filed: Feb. 14, 1989

[51] Int. Cl.[5] ..... F41B 5/00

[52] U.S. Cl. ..... 124/23.1; 124/86; 124/25.6; 124/900

[58] Field of Search ..... 124/23 R, 24 R, DIG. 1, 124/86, 90

[56] References Cited

U.S. PATENT DOCUMENTS

| | | | |
|---|---|---|---|
| 4,353,346 | 10/1982 | Barna | 124/24 R |
| 4,440,142 | 4/1984 | Simonds | 124/DIG. 1 X |
| 4,478,203 | 10/1984 | Hayes | 124/DIG. 1 X |
| 4,686,955 | 8/1987 | Larson | 124/DIG. 1 X |
| 4,781,167 | 11/1988 | Martin | 124/23 R |
| 4,838,236 | 6/1989 | Kudlacek | 124/23 R |

*Primary Examiner*—Randolph A. Reese
*Assistant Examiner*—Peter M. Cuomo
*Attorney, Agent, or Firm*—Barnes, Kisselle, Raisch, Choate, Whittemore & Hulbert

[57] ABSTRACT

An archery bow of the compound type with eccentrically mounted cam wheels or pulleys, one to carry the bowstring at each end, and one to carry the tension cable at each end. The tension cables are anchored at each end on small grooved discs which retain closed loops at the anchor end of the cables. The discs are centrally perforate to receive and be retained by an axle which also mounts the pulleys. Each disc has a plurality of slotted openings, or notches around a center, terminating in bights which are progressively at different distances from the center. This allows selective tensioning on the tension cables to tune the bow and adjust cable length.

1 Claim, 1 Drawing Sheet

COMPOUND BOW WITH ADJUSTABLE CABLE ANCHOR

FIELD OF INVENTION

Compound bows with bowstring and tension cables and adjustable devices for tension cables.

BACKGROUND OF INVENTION AND FEATURES

The compound bow has become popular among archers after the development initiated primarily by Holless W. Allen who was granted U.S. Pat. No. 3,486,495 on Dec. 30, 1969. This patent discloses a bowstring passing over a first cam pulley which is eccentrically mounted at the distal end of bow limbs. As the bowstring is drawn, the bowstring cable unwraps from the cam pulley. However, a second pulley is mounted adjacent to and turns with the first pulley and a tension cable on this second pulley wraps up on the second pulley as the bowstring is drawn. The tension pulley has each end anchored at the distal end of a bow, usually on the axle mounting the pulleys, and the tension pulley extends from each anchor point at one end to the second pulley at the other end.

Archers' bows may have a bowstring pull varying all the way from 15 pounds to 100 pounds. When the rating gets above 35 pounds, it requires a rather strong person to pull the bowstring back to the release position and to hold the arrow in this position while it is being aimed. With the improved bow construction (devised by Allen), the pull on the bowstring is high at the beginning of the draw but the arm at this point is able to exert a maximum force. As the draw progresses a little beyond mid-point, there is an overcenter action on eccentric pulleys which decreases the draw force needed to maintain the bowstring in drawn position without decreasing the energy stored in the limbs of the bow. Thus, at full drawn, it is relatively easy to hold the arrow and bowstring and much easier to perfect the aiming technique and the proper finger release.

Modern bows are usually fashioned with a rigid handle portion centrally located and flexing bow limbs mounted at the proximal ends on each end of the handle portion. The pulleys are mounted on the distal ends of the bow limbs which are usually bifurcate and transfixed by the axle on which the pulleys rotate. The flexing bow limbs are formed as composite laminations of special wood or solid fiberglass and are usually well matched as to flexibility. However, an imbalance can be caused by improper assembly of the bow components or because of unequal stretch characteristics of the cables or bowstring. This imbalance is undesirable and various correctional devices have been proposed.

A U.S. patent to Darlington 3,987,777 (1976) shows supplemental pulleys on the bow handle which would allow adjustment of one or both ends to achieve what is referred to as tuning. A U.S. patent to Simonds 4,440,142 (1984) illustrates a means of anchoring the tension or timing pulleys utilizing a separate pulley sheave mounted on a looped bridle cable at each end of the bow. The sheave has a plurality of notches with varying dimension to adjust the anchor point of the tension cable.

The present invention contemplates the use of an anchor disc mounted directly on the pulley axle to avoid the use of the complicated bridle assembly and simplify the means of adjusting tension cable lengths for tuning and draw lengths.

Objects and features of the invention will be evident in the following description and claims in which the principles of the invention are set forth together with details to permit persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
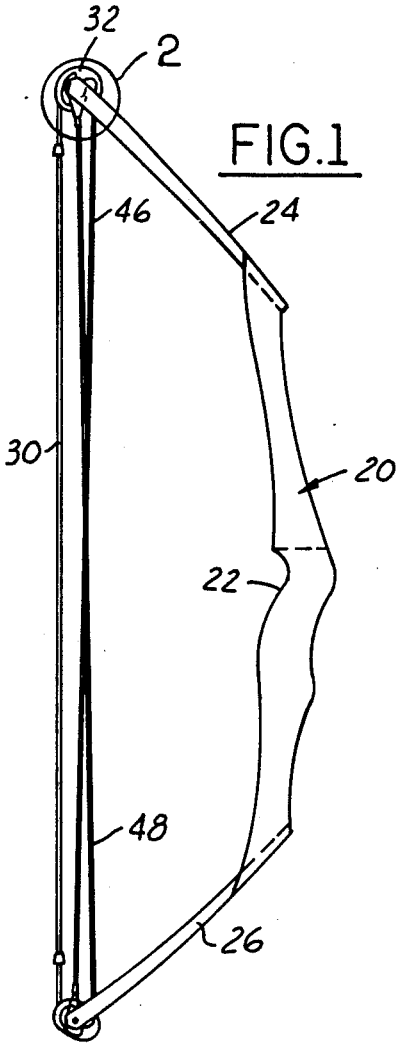
FIG. 1, a side elevation of a compound bow having the bowstring and tension eccentric pulleys.
Figure 2:
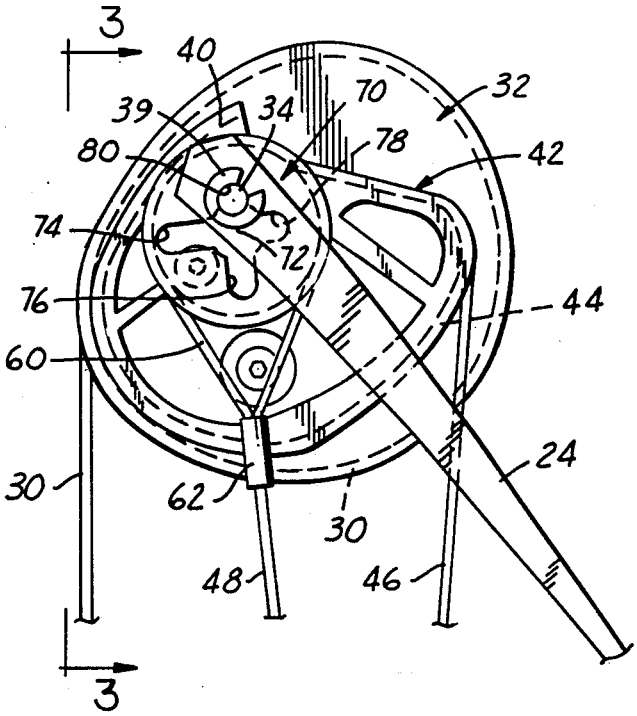
FIG. 2, an enlargement of the circled portion of FIG. 1 marked 2.
Figure 3:
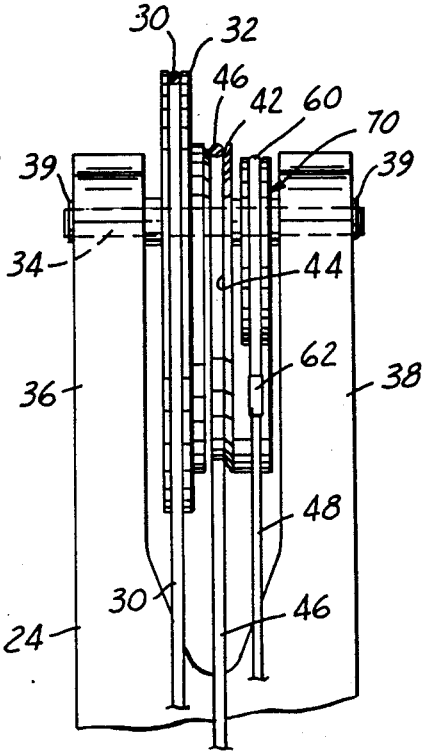
FIG. 3, a face-on view of the pulley assembly of FIG. 2.

In FIG. 1, a compound bow is illustrated with a rigid handle portion 20 having a shaped grip 22. At each end of the handle are mounted respective flexing bow limbs 24 and 26. With reference to FIGS. 1 and 2, a bowstring 30 is wrapped around a main eccentric pulley 32 which is mounted on an axle 34 transfixing bifurcate portions 36 and 38 at the end of bow limb 24. The axle is retained by C washers 39. This bowstring may either terminate in a suitable holding device at about 40 or pass diametrically through the pulley assembly and jog axially to reach a tension pulley sheave 42 where it will travel in the groove 44 as a tension cable 46.

It will be evident that as the bowstring 30 is drawn, it will unwrap from the pulle 32 while the counterclockwise motion of the pulley assembly will cause the tension cable to wrap on to the pulley sheave 42. Tension cable 46 is anchored at the lower end of the bow as shown in FIG. 1 and the other run 48 of the tension cable will pass around a corresponding pulley assembly at the lower end of the bow and be anchored at the top. It will be appreciated that various pulley assemblies may be utilized as exemplified in numerous patents in the compound bow art.

It should be recognized that most bow designs have anchored the tension cables at respective ends of the bow by looping the end in a stable loop and mounting it on a small grooved, disc transfixed by the axle mount of the pulleys. Such a mount is illustrated in a U.S. patent to Darlington 4,756,296 (1988).

The present invention departs from this standard means of mounting by utilizing a disc grooved to receive the bight of the loop and still mounted on the axle. As viewed in FIG. 2, the loop of the tension cable 48 is formed at 60 and retained by a cable clamp 62. This loop is retained in an external groove of a disc 70 which has four quadriaxonial notches disposed at 90° circumferential spacing around a center point 72. Each of these notches have a bight with a different radial depth from center starting with the longest 74 and progressively ensmalling at 76, 78 to the shortest 80. In FIG. 2, the shortest notch 80 is engaged with the axle 34.

Figure 4:
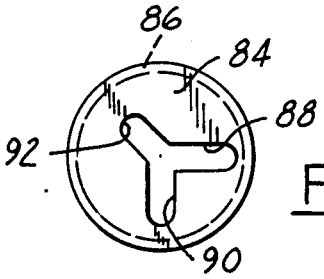
FIG. 4, an elevation of a modified cable mount disc.
Figure 5:
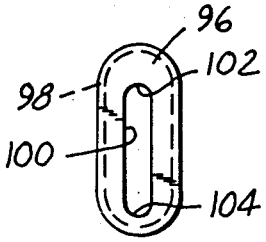
FIG. 5, an elevation of a second modified cable mount.

Modified discs are shown in FIGS. 4 and 5. In FIG. 4, a disc 84 with a cable groove 86 has three progressive triaxonial notches from longest 88 to intermediate 90 to the shortest 92. In FIG. 5, an elongate shaped element 96 with a cable groove 98 has a slot 100 which is offset axially to provide a short adjustment at 102 and a long adjustment at 104.

Thus, in utilizing the basic cable anchor unit for the tension cables, a means of adjustment of the cables is provided very simply without the necessity of modification of the pulley system or axle mount. Each end of the bow can be adjusted individually, if there is an imbalance, to effectively tune the bow and varying cable lengths can also be achieved in the same way by rotating an anchor disc.

What is claimed is:

1. In a compound archery bow having bowstring pulleys and tension cable pulleys mounted on a common axle at each distal end of the bow and anchor points of the respective ends of the tension cable, that improvement in the anchor points for the ends of the tension cable which comprises a perforate disc mounted on each end of the tension cable having an external groove to receive a bight portion of a closed stable loop of a tension cable end, said disc having a reference point and formed therein a plurality of notches of different lengths around said reference point, each notch being open at an inner end to the reference point and having a bight at a closed end opposite to the reference point to receive and anchor on a pulley axle in various positions of adjustment of the tension cable.

* * * * *